US007506642B2

(12) United States Patent
Edwards

(10) Patent No.: US 7,506,642 B2
(45) Date of Patent: Mar. 24, 2009

(54) HIGH-VELOCITY HUNTING SLINGSHOT

(75) Inventor: Christopher M. Edwards, Dayton, NV (US)

(73) Assignee: Fits Again LLC, Dayton, NV (US)

( * ) Notice: Subject to any disclaimer, the term of this patent is extended or adjusted under 35 U.S.C. 154(b) by 309 days.

(21) Appl. No.: 11/537,458

(22) Filed: Sep. 29, 2006

(65) Prior Publication Data

US 2008/0078367 A1 Apr. 3, 2008

(51) Int. Cl.
*F41B 3/02* (2006.01)

(52) U.S. Cl. ..... 124/20.1

(58) Field of Classification Search ..... 124/20.1, 124/20.2, 20.3; D22/106
See application file for complete search history.

(56) References Cited

U.S. PATENT DOCUMENTS 3,306,278 A * 2/1967 Spatari ..... 124/22
3,749,075 A * 7/1973 Saunders ..... 124/20.1
3,812,834 A * 5/1974 Saunders ..... 124/20.1
3,865,094 A * 2/1975 Sweeney ..... 124/20.1
3,875,923 A * 4/1975 Horel ..... 124/20.1
3,901,209 A * 8/1975 Woolsey et al. ..... 124/20.1
D297,041 S * 8/1988 Bongiorni ..... D22/106
4,873,963 A * 10/1989 Lemmen ..... 124/20.3
5,632,262 A * 5/1997 Hanson ..... 124/20.1
5,894,672 A * 4/1999 Ellenburg et al. ..... 33/265
6,595,160 B1 * 7/2003 Williamson ..... 119/702

* cited by examiner

*Primary Examiner*—John Ricci
(74) *Attorney, Agent, or Firm*—Lewis and Roca LLP

(57) ABSTRACT

A high-power and high-velocity slingshot comprising: a handle; a forearm brace configured to be coupled to the bottom end of the handle; an assembly rod configured to be coupled to the top end of the handle; a left yoke branch configured to be coupled to the assembly rod opposite the handle such that the left yoke branch may swivel about the assembly rod; a right yoke branch configured to be coupled to the assembly rod opposite the handle such that the right yoke branch may swivel about the assembly rod; an ammunition pouch configured to receive and release ammunition; a first tubular thrust band configured to couple the ammunition pouch to the left yoke branch opposite the assembly rod; and a second tubular thrust band configured to couple the ammunition pouch to the right yoke branch opposite the assembly rod.

20 Claims, 16 Drawing Sheets

HIGH-VELOCITY HUNTING SLINGSHOT

BACKGROUND

1. Field of the Invention

The present invention relates to slingshots. More particularly, the present invention relates to a high-velocity hunting slingshot.

2. The Prior Art

Prior slingshot designs have attempted to obtain more power by several methods that enhance the power of the rubber thrust bands or tubes, without actually increasing the size of the tubes. When the tubes are ⅜" in diameter or greater, all prior designs fail to function at the longest stretch of the tubes. The failures result from the handle twisting in the hand, the handle being pulled backward, the tubes pulling away from the yoke or pouch, and the tubes tearing at the yoke or pouch.

What is needed is a high power and high velocity slingshot that overcomes the deficiencies of the prior art and that falls between a bow and arrow and a slingshot as a hunting weapon, without resorting to mechanical means such as springs.

SUMMARY

The present invention provides a high-power and high-velocity slingshot that overcomes the deficiencies of the prior art and that falls between a bow and arrow and a slingshot as a hunting weapon, without resorting to mechanical means such as springs, offering several advantages over the prior art.

It is an object of the present invention to provide an overall construction of a slingshot that enables the slingshot to be assembled and disassembled without tools.

It is another object of the present invention to provide a rotating top assembly enabling the top assembly of the slingshot to be rotated about 180 degrees from a shooting-ready position to a travel-ready position where one side of the slingshot is flat for attachment to a back pack.

It is yet another object of the present invention to provide a slingshot that shoots with greater velocity than the prior art slingshot. The slingshot is not a toy, but rather a true hunting weapon falling between a bow and arrow and slingshot, allowing further distance for small game targets and take down ability for larger prey that are too large for a slingshot and not desirable for a bow and arrow.

It is yet another object of the present invention to provide a slingshot having a uniquely shaped extended upper rod that extends the length of draw of the larger size tube to increase thrust.

It is yet another object of the present invention to provide a slingshot having a uniquely shaped extended forearm brace that is easy for the user to insert his hand through and quickly grasp the handle, can be shaped for a more secure fit against the asymmetrical top of the forearm, uses the forearm as a stronger brace than the wrist, and is designed to be shot like a bow and arrow, angled away from the handle, thereby forcing the shooter to hold the handle in the strongest position of the wrist.

It is yet another object of the present invention to provide a slingshot configured to use ⅜" or larger thrust tubes. The slingshot uses these larger tubes at their longest stretch length for greater velocity than those tubes would produce if attached to the other designs. The reason for this advantage is that the other designs do not clamp the tube to the yoke and do not clamp the tubes to the pouch attachment. Furthermore, typical prior art designs do not swivel the yoke to prevent sidewall tearing of the tube, such as when the bend in the tube causes extra stress and tearing of the side wall where the tube presses against the end of the yoke.

It is yet another object of the present invention to provide a slingshot using clamps to secure the tubes. The clamps help prevent the tubes from pulling off of the end of the yoke and/or pouch attachment when large tubes are stretched for maximum power.

It is yet another object of the present invention to provide a slingshot using rubber end caps that make it even harder for the tubes to pull free from the yokes and/or pouch attachment. These rubber end caps also protect the inner walls of the tubes from being ripped by the steel yokes.

It is yet another object of the present invention to provide a slingshot having a large handle. The larger than usual handle makes a stronger overall weapon that has room inside for spare parts, not just ammunition.

It is yet another object of the present invention to provide a slingshot with an improved ammunition pouch design. The pouch preferably uses sewn in rings to attach to linchpins that then go into the tube. This combination results in an extremely strong pouch capable of drawing the tubes to their most powerful stretched position.

It is yet another object of the present invention to provide a slingshot that utilizes a swivel yoke design. The swivel yoke attaches to the rod assembly without tools. Due to the rotation of the yokes, the tubes are aligned in a V-shape between the yokes and the ammunition pouch, thereby allowing for the longest stretch of the tubes without sidewall stress to the tubes.

It is yet another object of the present invention to provide a slingshot that improves the angle of shooter's grip and stance. When the slingshot is held at an angle away from the shooter, the hand is turned at the wrist to such a degree that the top of the thumb bone is straight toward the direction of fire and horizontally aligned with the wrist bone for the strongest possible grip. The pull is close to 100 lbs. on the draw arm, the grip hand pushes forward to keep the aim level, and the grip arm pushes forward as well, resulting in the feel of power of the shot being closer to a bow and arrow than any slingshot.

It is yet another object of the present invention to provide a slingshot having high target penetration. In test firing of the present invention, the slingshot put steel shot through both sides of a soda can from 30 yards away. None of the prior art slingshot designs could possibly achieve this high degree of penetration.

This slingshot allows the user to hunt small game at greater distances. It also allows the hunting of larger game that cannot be hunted with a traditional slingshot and for which a bow and arrow is impractical.

The slingshot can be used by hunters and target shooters. It can also be an addition to emergency survival kits for home, military, backpackers, wilderness survivalists, campers, ocean vessels, airplanes, helicopters, and off-road vehicles.

In an exemplary embodiment, the slingshot of the present invention comprises a handle having a top end, a bottom end opposite the top end, an interior half, an exterior half, and a lengthwise axis separating the interior half from the exterior half. The slingshot also comprises a forearm brace configured to be coupled to the bottom end of the handle. The forearm brace comprises a first brace side and a second brace side, wherein the first brace side and the second brace side extend away from the bottom end, bending upward in a direction away from the lengthwise axis towards the interior half and then back towards the bottom end, and meeting each other to form a top brace side configured to receive and rest on a user's forearm when the forearm brace is coupled to the bottom end.

The slingshot further comprises an assembly rod configured to be coupled to the top end of the handle. The assembly rod comprises a first assembly rod side and a second assembly rod side, wherein the first assembly rod side and the second assembly rod side extend away from the top end in a V-shape, first bending downward in a direction away from the lengthwise axis towards the exterior half, then bending upwards towards the lengthwise axis when the assembly rod is coupled to the top end. The slingshot further includes a left yoke branch configured to be coupled to the first assembly rod side opposite the handle such that the left yoke branch may swivel about the first assembly rod side, a right yoke branch configured to be coupled to the second assembly rod side opposite the handle such that the right yoke branch may swivel about the second assembly rod side, an ammunition pouch having a first end and a second end opposite the first end and configured to receive and release ammunition, a first tubular thrust band configured to couple the first end of the ammunition pouch to the left yoke branch opposite the assembly rod, and a second tubular thrust band configured to couple the second end of the ammunition pouch to the right yoke branch opposite the assembly rod.

DETAILED DESCRIPTION

Figure 1:
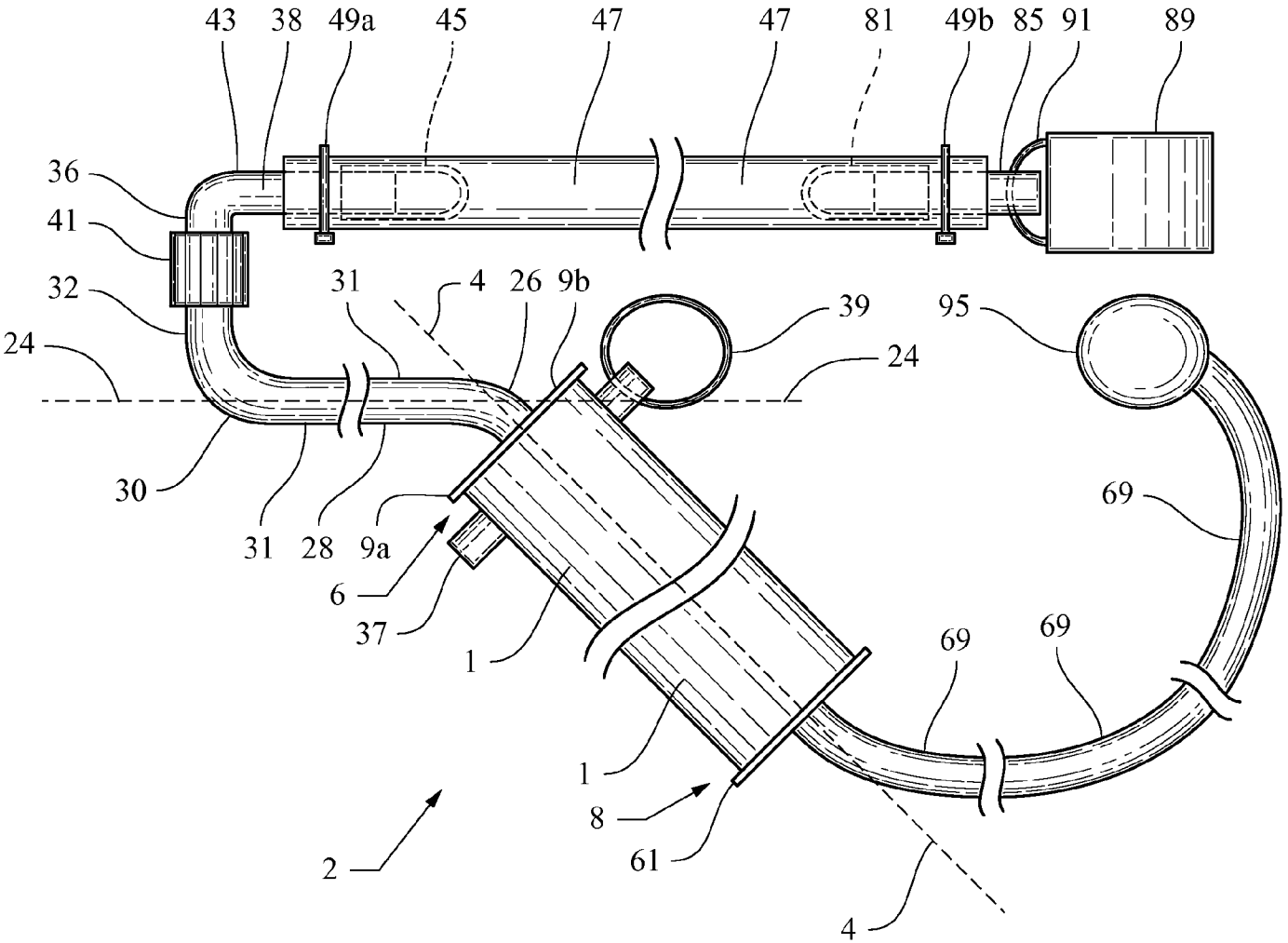
FIG. 1 is a left side view of an exemplary slingshot in accordance with the present invention.

Persons of ordinary skill in the art will realize that the following disclosure is illustrative only and not in any way limiting. Other embodiments of the invention will readily suggest themselves to such skilled persons having the benefit of this disclosure.

In FIGS. 1 through 29, an exemplary embodiment of a slingshot 2 is shown, wherein like elements are numbered alike.

In a preferred embodiment, slingshot 2 comprises a handle 1 having a top end 6, a bottom end 8 opposite the top end, and a lengthwise axis 4 separating an interior half from an exterior half. Slingshot 2 also includes a forearm brace 69 configured to be coupled to the bottom end 8 of handle 1. The forearm brace 69 preferably comprises a first brace side 10 and a second brace side 12, wherein the first brace side 10 and the second brace side 12 extend away from the bottom end 8, bending upward in a direction away from the lengthwise axis 4 towards the interior half of the handle and then back towards the bottom end 8 of handle 1, and meeting each other to form a top brace side 14 configured to receive and rest on a user's forearm when the forearm brace 69 is coupled to the bottom end 8.

Slingshot 2 also comprises an assembly rod 31 configured to be coupled to the top end 6 of the handle 1. The assembly rod 31 preferably comprises a first assembly rod side 16 and a second assembly rod side 18, wherein the first assembly rod side 16 and the second assembly rod side 18 extend away from the top end 6 in a V-shape, first bending downward in a direction away from the lengthwise axis 4 towards the exterior half of the handle 1, then bending upwards towards the lengthwise axis 4 when the assembly rod 31 is coupled to the top end 6 of the handle 1.

Slingshot 2 further includes a left yoke branch 43 configured to be coupled to the first assembly rod side 16 opposite the handle 1 such that the left yoke branch 43 may swivel about the first assembly rod side 16. Slingshot 2 also includes a right yoke branch 53 configured to be coupled to the second assembly rod side 18 opposite the handle 1 such that the right yoke branch 53 may swivel about the second assembly rod side 18.

Slingshot 2 further comprises an ammunition pouch 89, having a first end 20 and a second end 22 opposite the first end 20, configured to receive and release ammunition. A first tubular thrust band 47 is configured to couple the first end 20 of the ammunition pouch 89 to the left yoke branch 43 opposite the assembly rod 31 and a second tubular thrust band 57 is configured to couple the second end 22 of the ammunition pouch 89 to the right yoke branch 53 opposite the assembly rod 31.

Handle 1 is configured to function as both a gripping handle and a storage compartment for spare tubular thrust bands, securing zip ties, ammunition, and other slingshot equipment. In a preferred embodiment, handle 1 is substantially tubular in shape, having a hollow interior.

Figure 5:
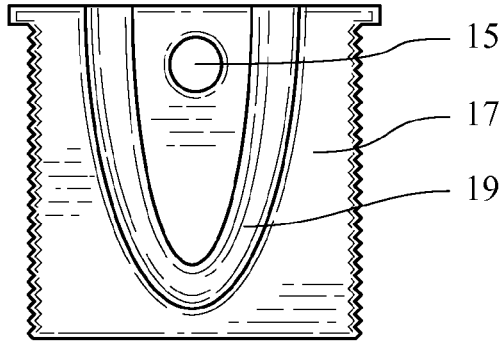
FIG. 5 is a side view of an exemplary embodiment of the flat side of the exterior half of the top cap shown in FIG. 3 in accordance with the present invention.
Figure 6:
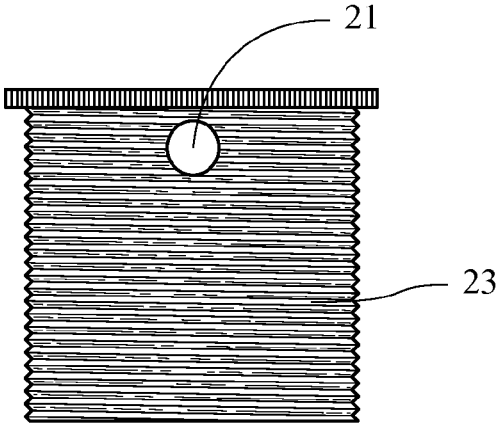
FIG. 6 is a side view of an exemplary embodiment of the threaded side of the interior half of the top cap shown in FIG. 3 in accordance with the present invention.
Figure 7:
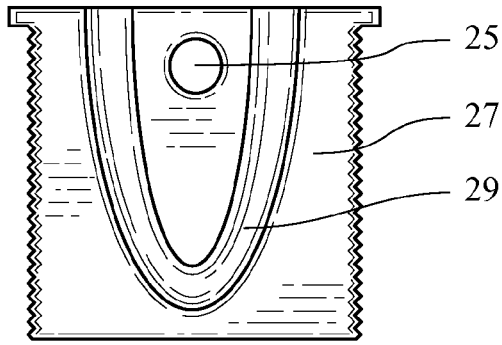
FIG. 7 is a side view of an exemplary embodiment of the flat side of the interior half of the top cap shown in FIG. 3 in accordance with the present invention.

Slingshot 2 may include a top cap that is configured to receive the assembly rod 31 and secure the assembly rod 31 to the handle 1. The top cap may be formed from two halves: an exterior half 9*a* toward the direction of fire and an interior half 9*b* toward the shooter. The exterior half 9*a* and the interior half 9*b* are configured to sandwich the assembly rod 31. Exterior half 9*a* and interior half 9*b* each have an interior surface, 17 and 27 respectively, and an exterior surface, 13 and 23 respectively. The interior surface has a groove configured to receive the first assembly rod side 16 and a groove configured to receive the second assembly rod side 18, wherein the interior surface of the exterior half 9*a* and the interior surface of the interior half 9*b* are configured to be placed together such that the grooves on the exterior half 9*a* and the interior half 9*b* form receiver holes for receiving the first assembly rod side 16 and the second assembly rod side 18. These grooves may be linked to form one continuous hollowed out receiving groove, such as grooves 19 and 29 on exterior half 9*a* and interior half 9*b*, as seen in FIGS. 5 and 7. These grooves 19 and 29 may form a substantially semi-circular groove. In a preferred embodiment, the assembly rod 31 and the grooves are sized and shaped such that about half the rod's thickness can fit inside the grooves. Preferably, the interior surfaces 17 and 27 are substantially planar except for the grooves.

Figure 2:
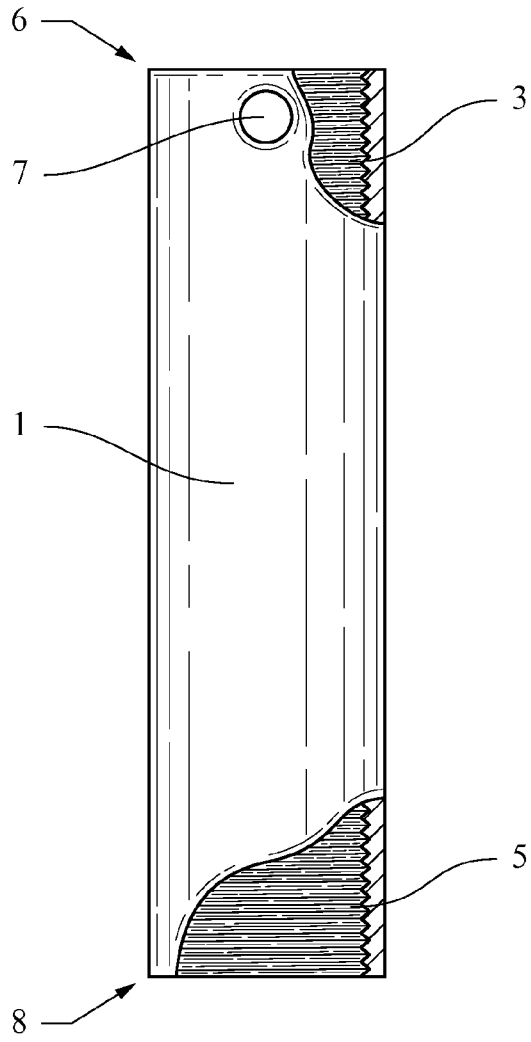
FIG. 2 is a side view of an exemplary grip and storage tube in accordance with the present invention.
Figure 3:
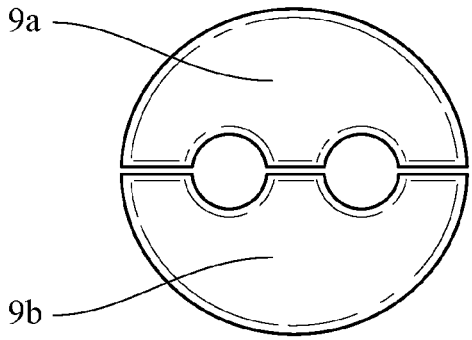
FIG. 3 is a plan view of an exemplary top cap in accordance with the present invention.
Figure 4:
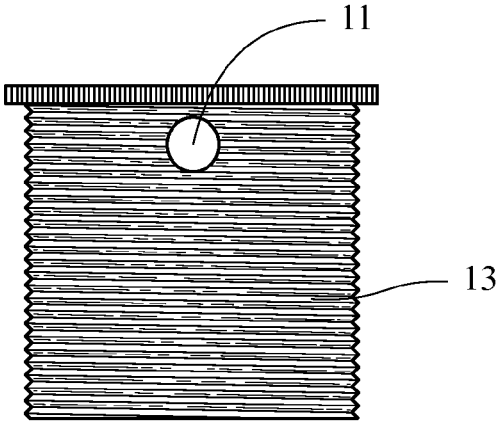
FIG. 4 is a side view of an exemplary embodiment of the threaded side of the exterior half of the top cap shown in FIG. 3 in accordance with the present invention.

The top end 6 of handle 1 and the top cap are configured to securely mate with one another. In a preferred embodiment, the handle 1 has a threaded interior surface 3 at the top end 6 and a threaded interior surface 5 at the bottom end 8, as seen in FIG. 2. The exterior surfaces 13 and 23 of the exterior half 9*a* and the interior half 9*b* may be threaded in order to screw into the top end 6 of handle 1. Preferably exterior surfaces 13 and 23 are substantially convex. For example, they may be substantially semi-circular in shape in order to correspond with the tubular shape of the handle 1.

The interior surface of the bottom end 8 of the handle 1 may be threaded as well in order to accept a bottom cap 61, which will be discussed in more detail below.

The handle 1 preferably comprises an aperture 7 on two opposite sides proximate the top end 6. In this preferred embodiment, the exterior half 9*a* and the interior half 9*b* of the top cap each comprise an aperture that corresponds in location and size to the apertures 7 on the handle 1 and extend from the interior surfaces 17 and 27 to the exterior surfaces 13 and 23. The apertures on the handle 1 and the top cap are configured to line up when the top cap is coupled to the handle 1 and to receive a securing mechanism, such as linchpin 37, such that the securing mechanism prevents the rotation of the top cap and the assembly rod 31 with respect to the handle 1. These apertures may be slightly elongated vertically so that if the top cap is rotated 180 degrees, the linchpin 37 will still be able to pass through them. Linchpin 37 may have a linchpin pull-ring 39 that goes through a hole in the linchpin 37 to aid in pulling the linchpin 37 out of the handle 1.

FIGS. 4-7 provide an exemplary embodiment of these apertures. Exterior half 9*a* comprises an aperture 11 on its exterior surface 13 that extends all the way to and communicates with an aperture 15 on the interior surface 17 of exterior half 9*a*. Interior half 9*b* comprises an aperture 21 on its exterior surface 23 that extends all the way to and communicates with an aperture 25 on the interior surface 27 of interior half 9*b*.

The assembly rod 31 is preferably configured to be rotated about 180 degrees from a shooting-ready position, where the user may shoot ammunition from the slingshot, to a travel-ready position, where the user may attach the slingshot to a back pack. FIGS. 1, 8-10 and 27 illustrate exemplary embodiments of the assembly rod 31 configured in a shooting-ready position.

In a preferred embodiment, the first assembly rod side 16 and the second assembly rod side 18 each comprise a first bent portion 26, a horizontal portion 28, a second bent portion 30, and a vertical portion 32. The vertical portion 32 is configured to be coupled to the left yoke branch 43 and said right yoke branch 53. When the assembly rod 31 is coupled to the top end 6 of handle 1 in the shooting-ready position, the first bent portion 26 extends away from the top end 6 and bends downward in a direction away from the lengthwise axis 4 towards the exterior half 9*a*. The first bent portion 26 extends into the horizontal portion 28. The horizontal portion 28 is substantially straight and parallel with the horizontal axis 24 when the handle 1 is held such that its lengthwise axis 4 is at an angle of about 45 degrees with respect to the horizontal axis 24. The horizontal portion 28 extends into the second bent portion 30 that bends upwards towards the lengthwise axis 4 and leads into the vertical portion 32. The vertical portion 32 is substantially straight and perpendicular to the horizontal axis 24 when the handle 1 is held such that its lengthwise axis 4 is at an angle of about 45 degrees with respect to the horizontal axis 24.

Figure 8:
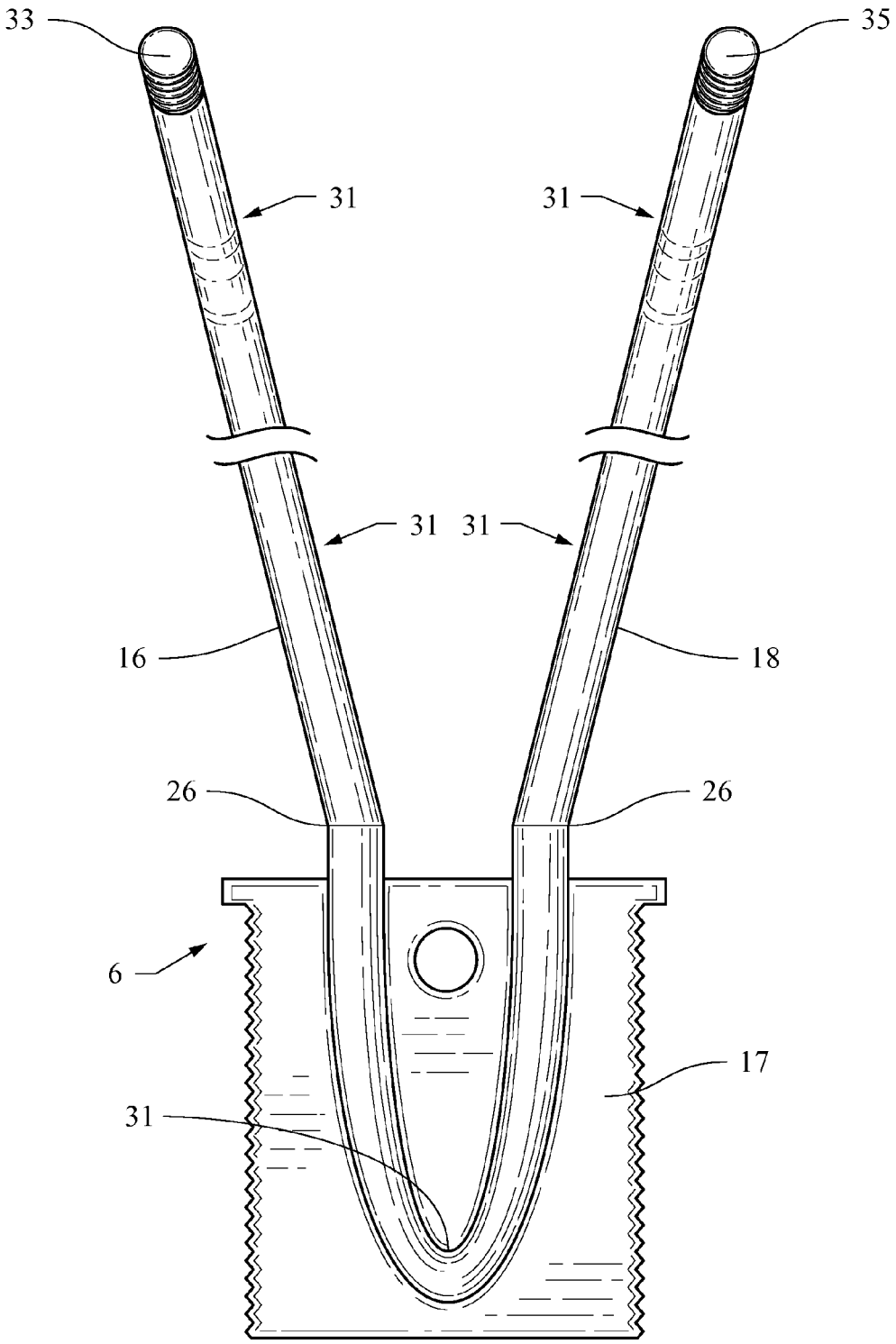
FIG. 8 is a front view of an exemplary embodiment of the main top assembly rod within the flat side of the exterior half of the top cap in accordance with the present invention.
Figure 9:
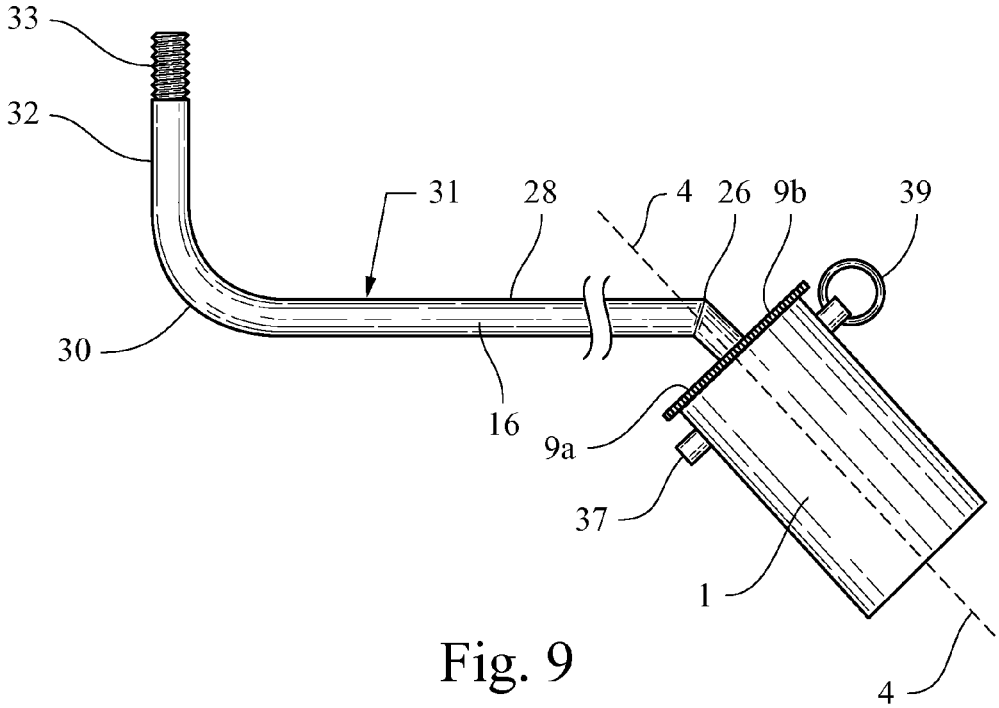
FIG. 9 is a left side view of an exemplary embodiment of the main top assembly rod within the flat side of the exterior half of the top cap in accordance with the present invention.
Figure 10:
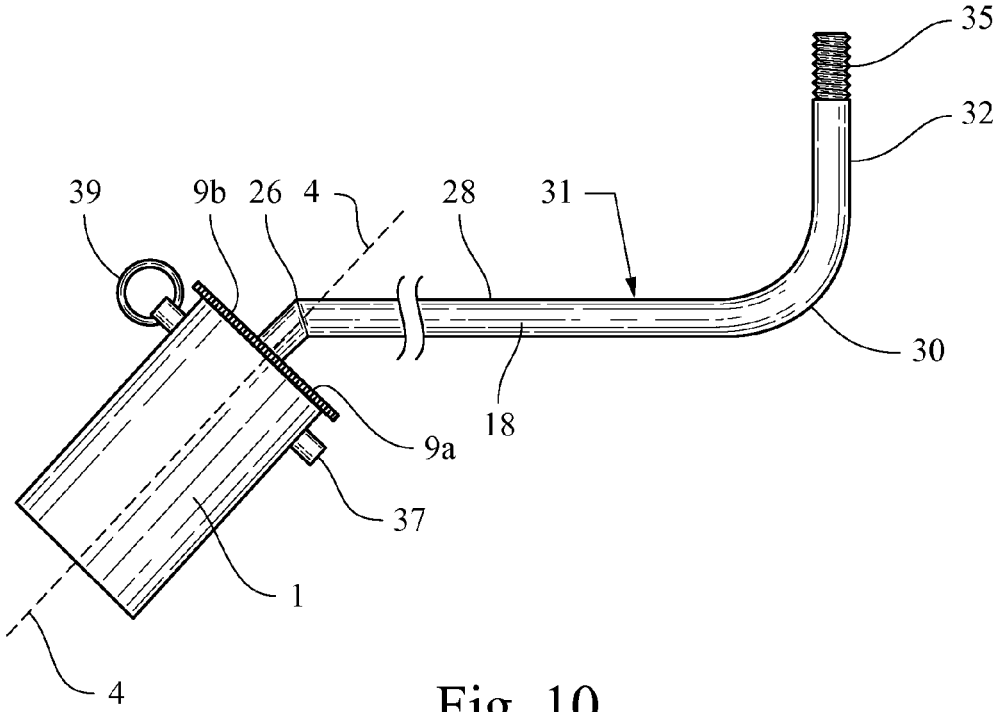
FIG. 10 is a right side view of an exemplary embodiment of the main top assembly rod within the flat side of the exterior half of the top cap in accordance with the present invention.
Figure 11:
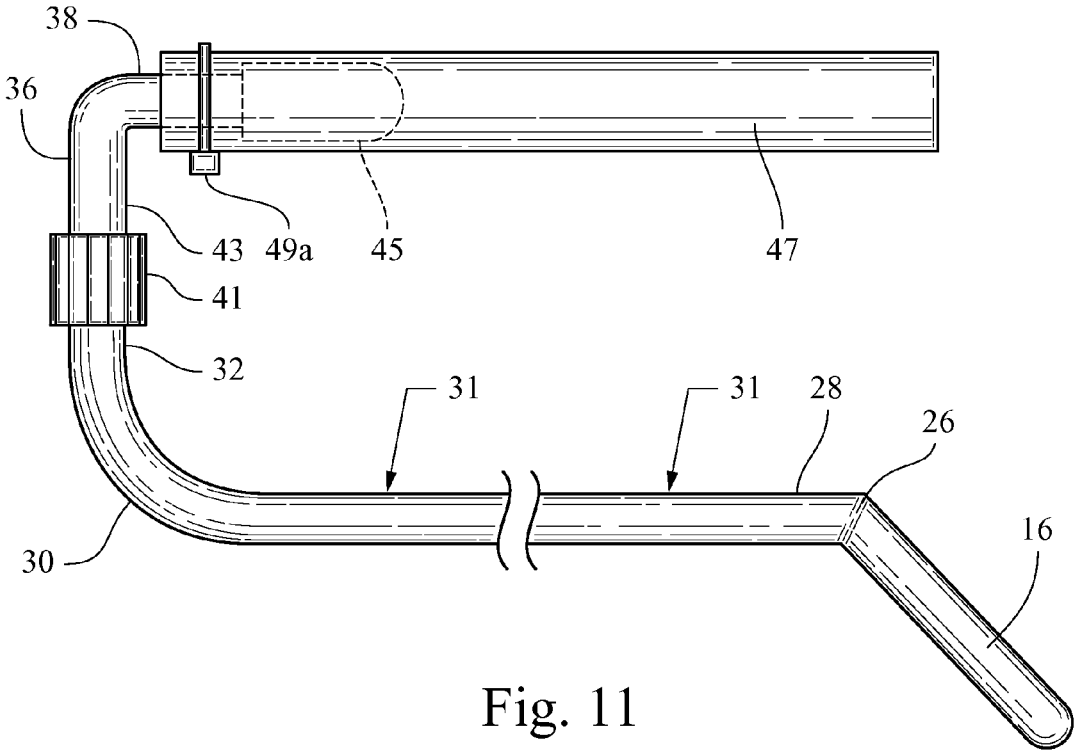
FIG. 11 is a left side view of an exemplary embodiment of the main top assembly rod connected to a tubular thrust band in accordance with the present invention.
Figure 12:
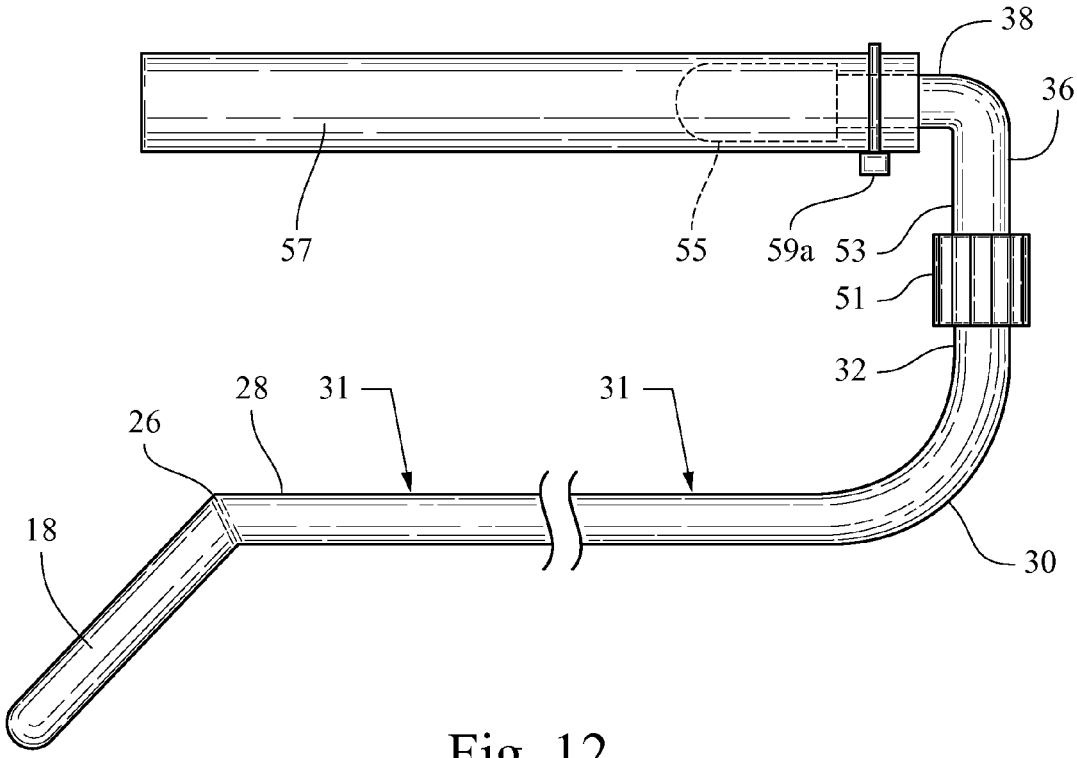
FIG. 12 is a right side view of an exemplary embodiment of the main top assembly rod connected to a tubular thrust band in accordance with the present invention.
Figure 13:
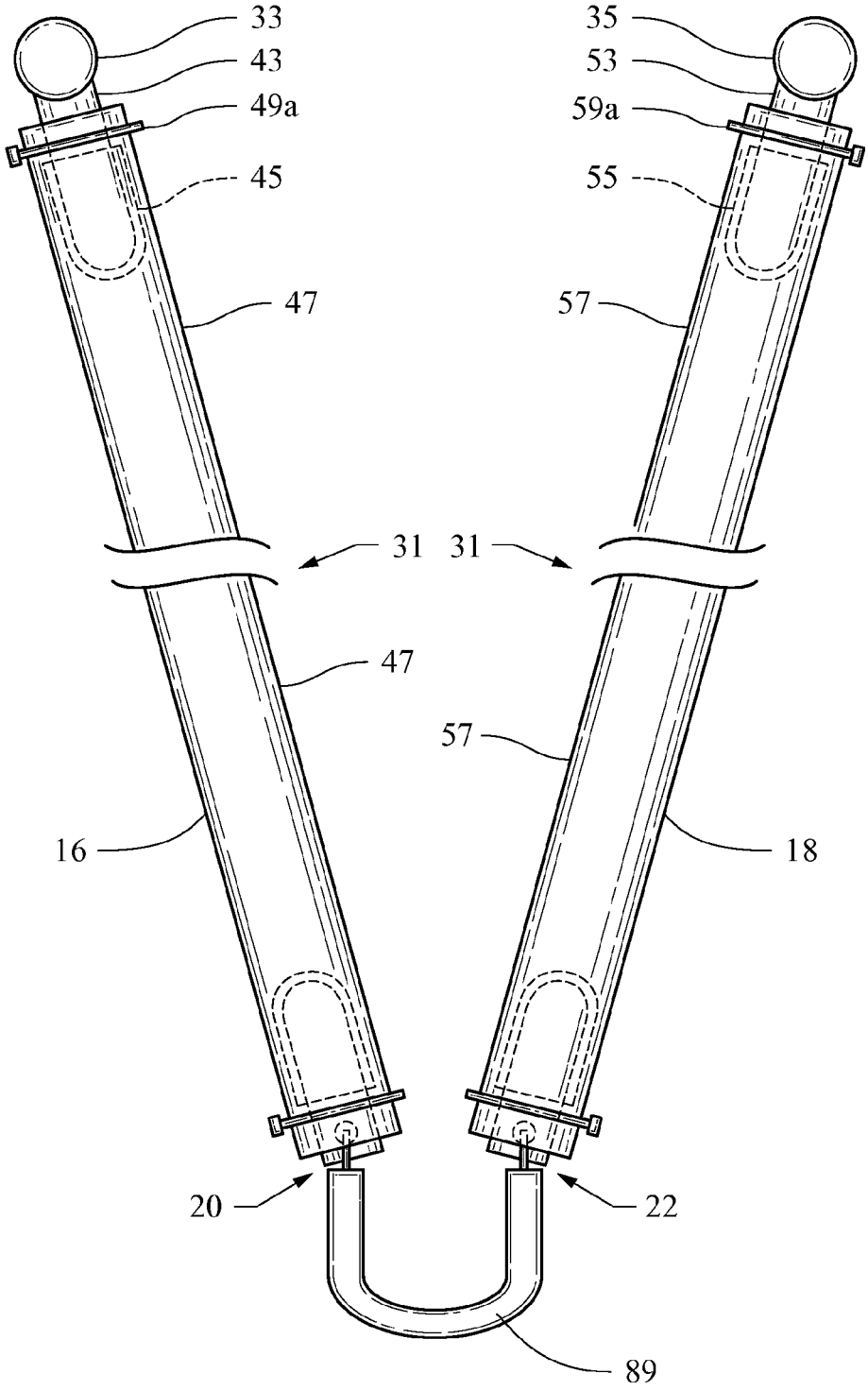
FIG. 13 is a plan view of an exemplary embodiment of the yoke branches connected to the ammo pouch by the tubular thrust bands in accordance with the present invention.
Figure 14:
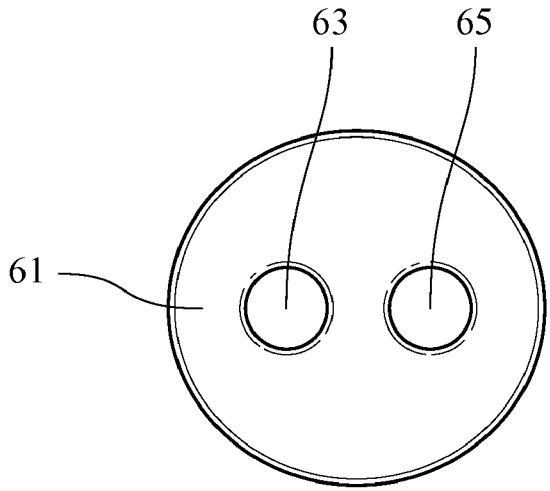
FIG. 14 is a plan view of an exemplary bottom cap in accordance with the present invention.
Figure 15:
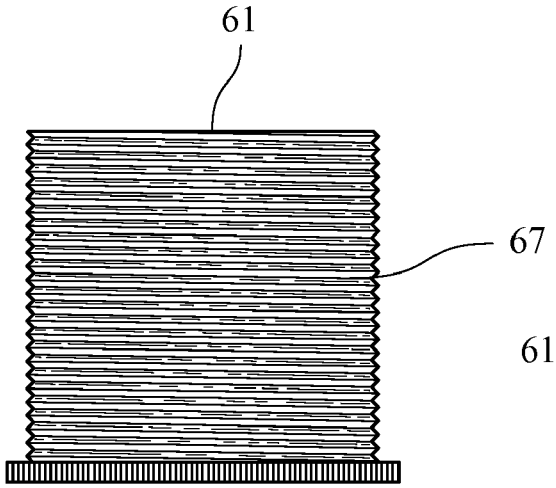
FIG. 15 is a side view of an exemplary embodiment of the threaded exterior of the top cap shown in FIG. 14 in accordance with the present invention.
Figure 16:
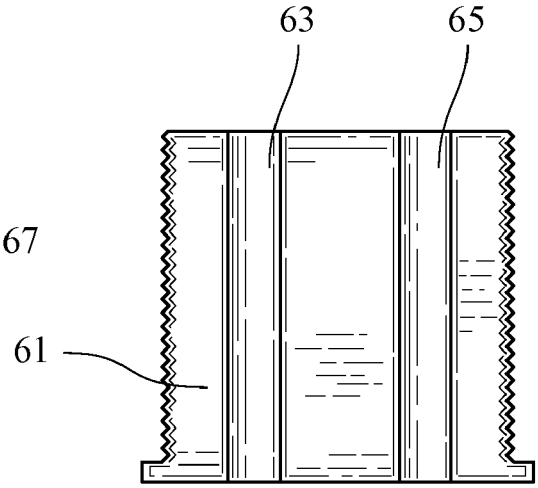
FIG. 16 is a cross-sectional side view of an exemplary embodiment of the interior of the top cap shown in FIG. 14 in accordance with the present invention.
Figure 17:
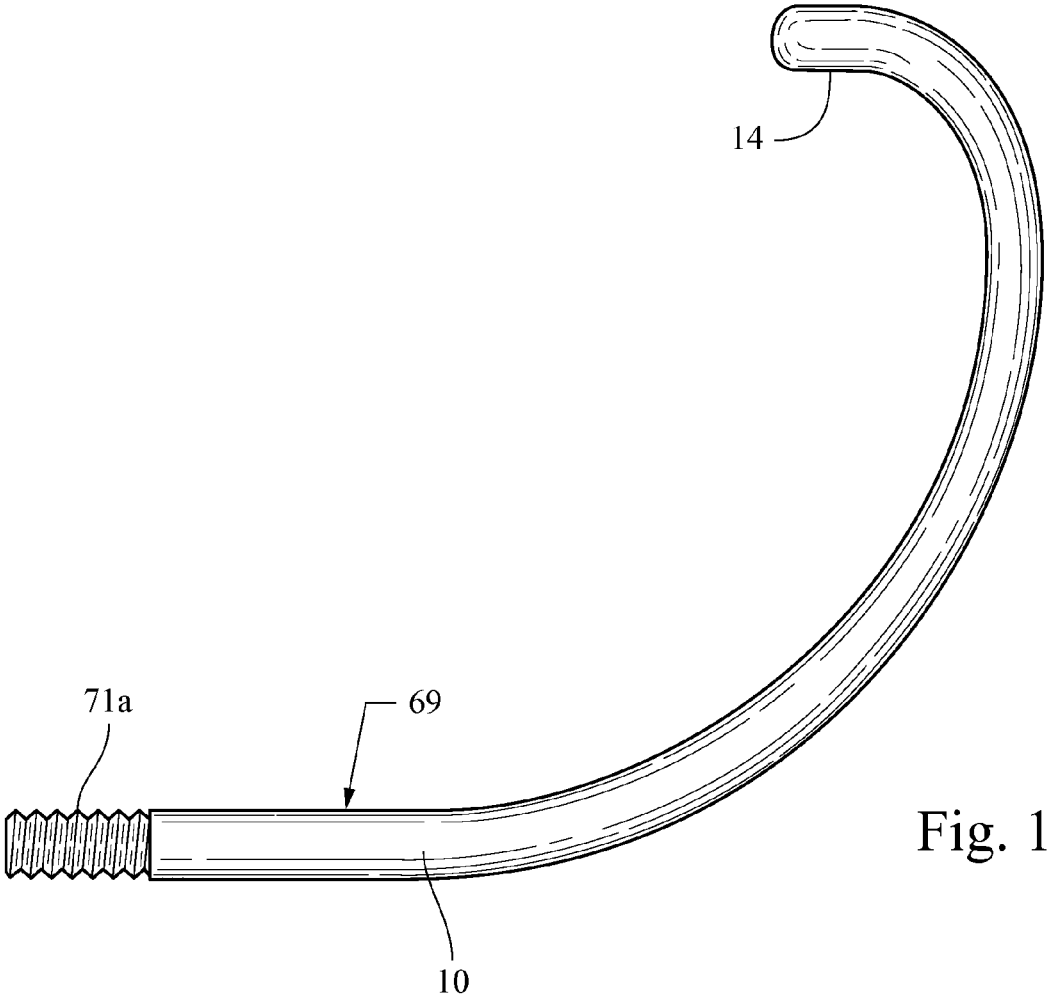
FIG. 17 is a left side view of an exemplary forearm brace in accordance with the present invention.
Figure 18:
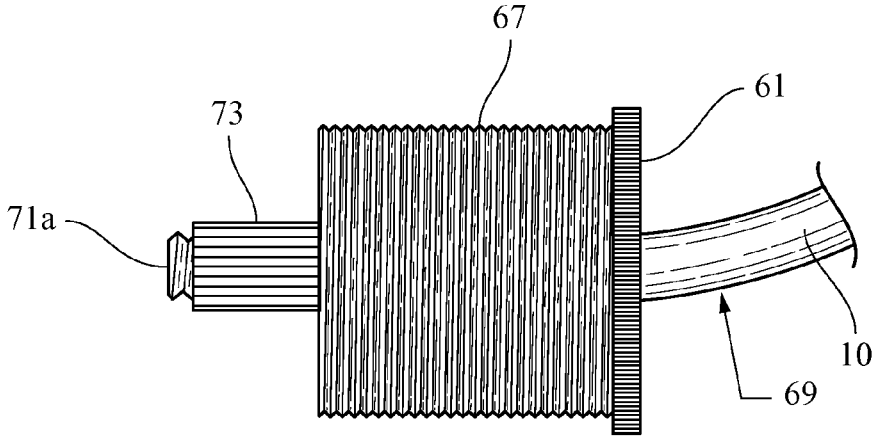
FIG. 18 is a left side view of an exemplary embodiment of the forearm brace connected to the bottom cap in accordance with the present invention.
Figure 19:
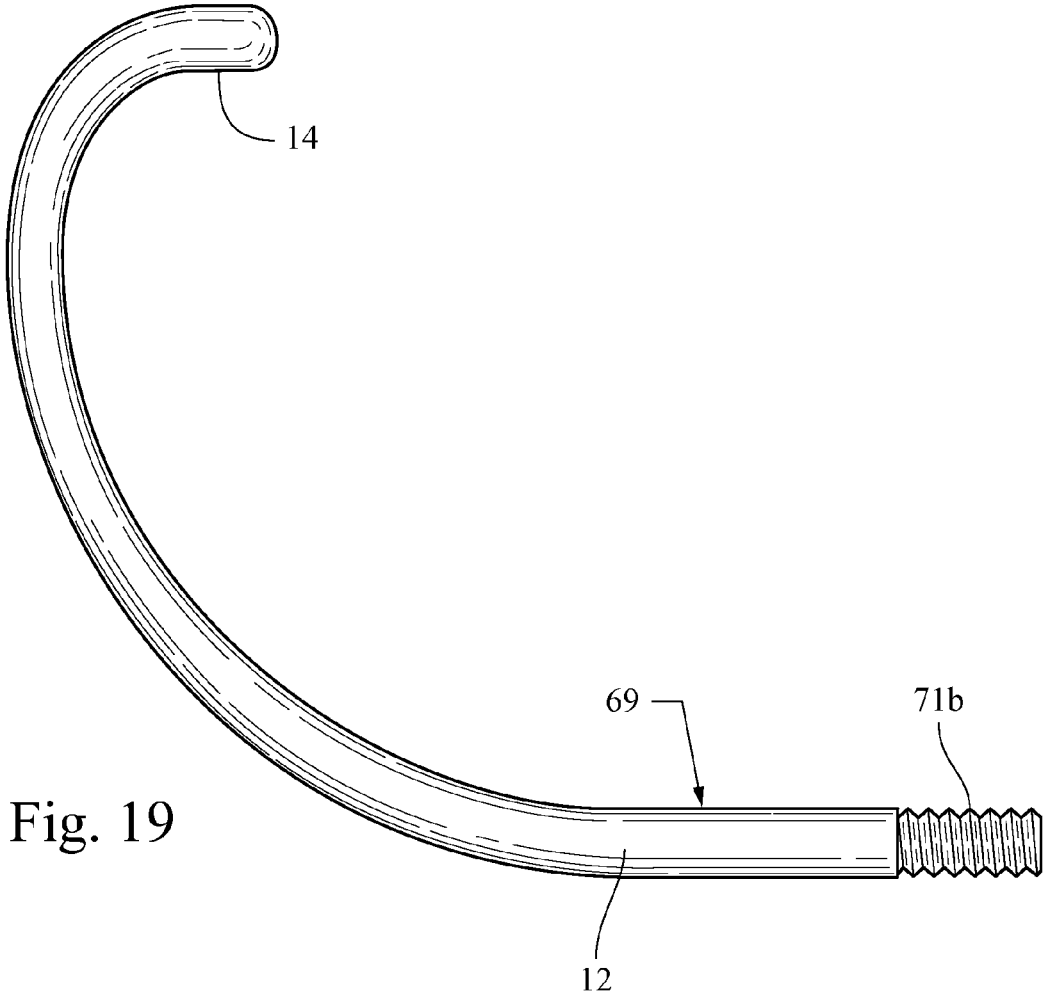
FIG. 19 is a right side view of an exemplary forearm brace in accordance with the present invention.
Figure 20:
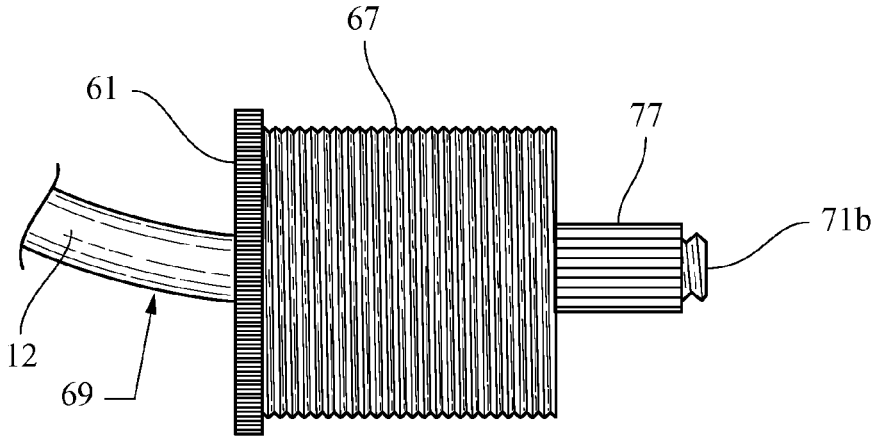
FIG. 20 is a right side view of an exemplary embodiment of the forearm brace connected to the bottom cap in accordance with the present invention.

As seen in FIG. 8, the first assembly rod side 16 and the second assembly rod side 18 may be connected by a continuous portion that links the first bent portion 26 of each in order to form a portion of the rod that corresponds to the grooves in the top cap. This portion can be formed in a variety of shapes, such as a V-shape or U-shape. The exterior half 9*a* and the interior half 9*b* could clamp over this portion and then screw into the handle 1.

The vertical portion 32 of the first assembly rod side 16 comprises a left end 33 configured to be coupled to left yoke branch 43 and the vertical portion 32 of the second assembly rod side 18 comprises a right end 35 configured to be coupled to right yoke branch 53. Both the left end 33 and the right end 35 may be threaded in order to accept a left connector nut 41 and a right connector nut 51, respectively. Connector nuts 41 and 51 are preferably steel nuts that can be turned by hand to connect the vertical portion 32 of the first assembly rod 16 and the second assembly rod 18 to the left yoke branch 43 and the right yoke branch 53, respectively.

The left yoke branch 43 and the right yoke branch 53 each preferably comprises a vertical branch 36, having a first end and a second end opposite the first end, and a horizontal branch 38, having a first end and a second end opposite the first end. The first end of the vertical branch 36 is configured to be coupled to the vertical portion 32 of the respective assembly rod side. The first end may be threaded in order to connect to the connector nuts and the assembly rod. The second end of the vertical branch 36 extends into the first end of the horizontal branch 38. In a preferred embodiment, the vertical branch 36 and the horizontal branch 38 are disposed substantially perpendicular with respect to one another and the horizontal branch 38 is substantially parallel with the horizontal axis 24 when the handle 1 is held such that its lengthwise axis 4 is at an angle of about 45 degrees with respect to the horizontal axis 24. The left yoke branch 43 and the right yoke branch 53 are preferably bent at an angle of about 90-degrees in order to provide a tip towards the shooter for attaching a tubular thrust band and any securing mechanisms.

The second end of the horizontal branch 38 on the left yoke branch 43 and the second yoke branch 53 is configured to be coupled to the first tubular thrust band 47 and the second tubular thrust band 57, respectively. The tubular thrust bands 47 and 57 are preferably rubber surgical tubing having an outside diameter of ⅜" or greater. This size tubing provides greater thrust for the projectile ammunition than the smaller sizes contemplated by previous designs.

The second end of the horizontal branch 38 on the left yoke branch 43 and the second yoke branch 53 may comprise a left end cap 45 and a right end cap 55, respectively. End caps 45 and 55 may either be integrally formed with horizontal branch 38 or be separate components configured to be securely attached to the second end of horizontal branch 38. In a preferred embodiment, end caps 45 and 55 are rubber caps that are disposed over the second end of horizontal branch 38. End caps 45 and 55 are greater in diameter than the rest of the horizontal branch 38. Therefore, when the tubular thrust bands 47 and 57 go over and beyond the end caps 45 and 55, a securing mechanism, such as zip ties 49*a* and 59*a*, can be wrapped around the respective thrust band and horizontal branch behind the end caps in order to secure the thrust band to the horizontal branch. Without the clamping of the securing mechanism, the tension of the oversize tubing would pull the thrust bands free from the horizontal branch when drawn back by the shooter.

Ammunition pouch 89 is configured to receive and release ammunition. In operation, ammunition is placed in the pouch. The pouch is then drawn back to tension the tubular thrust bands, and then released to fire the ammunition. In a preferred embodiment, ammunition pouch 89 is a nylon strap. The first end 20 and the second end 22 of ammunition pouch 89 may pass through a left pouch attachment ring 91 and a right pouch attachment ring 93, respectively, and are doubled back to be sewn to the ammunition pouch. This configuration results in the pouch attachment rings 91 and 93 being looped through an extremely strong pouch.

The pouch attachment rings 91 and 93 may be used to attach the first end 20 and the second end 22 of the ammunition pouch 89 to the tubular thrust bands 47 and 57, respectively. The pouch attachment rings 91 and 93 may be secured to a left pouch tube connector 85 and a right pouch tube connector 87, respectively. Pouch tube connectors 85 and 87 may be pins, such as linchpins, comprising a hole 34 on one end configured to receive and secure the attachment rings 91 and 93. In this fashion, pouch tube connectors 85 and 87 are secured to ammunition pouch 89 by pouch attachment rings 91 and 93. The end of pouch tube connectors 85 and 87 opposite the hole 34 is configured to be placed into the respective tubular thrust band. This end of left pouch tube connector 85 and right pouch tube connector 87 may comprise a left end cap 81 and a right end cap 83, respectively. End caps 81 and 83 may either be integrally formed with the pouch tube connectors 85 and 87 or be separate components configured to be securely attached to the pouch tube connectors 85 and 87. In a preferred embodiment, end caps 81 and 83 are rubber caps that are disposed over the pouch tube connectors 85 and 87. End caps 81 and 83 are greater in diameter than the rest of their respective pouch tube connector. Therefore, when the tubular thrust bands 47 and 57 go over and beyond the end caps 81 and 83, a securing mechanism, such as zip ties 49*b* and 59*b*, can be wrapped around the respective thrust band and pouch tube connector behind the end caps in order to secure the thrust band to the pouch tube connector. Without the clamping of the securing mechanism, the tension of the oversize tubing would pull the thrust bands free from the pouch tube connector when drawn back by the shooter.

The forearm brace 69 is configured to receive and rest on the shooter's forearm when the forearm brace 69 is coupled to the bottom end 8 of the handle 1. The forearm brace 69 may be coupled to the bottom end 8 in a variety of ways. In a preferred embodiment illustrated in FIGS. 1, 14-21 and 27-29, a bottom cap 61 is configured to receive the first brace side 10 and the second brace side 12 and secure the forearm brace 69 to the bottom end 8 of the handle 1. Bottom cap 61 may be substantially cylindrical and may have a threaded exterior surface 67 if appropriate in order to screw into the bottom end 8 of handle 1. The top surface of bottom cap 61 comprises a left receiving hole 63 and a right receiving hole 65. Receiving holes 63 and 65 are configured to receive the end of first brace side 10 and the end of second brace side 12, respectively. In this fashion, brace sides of the forearm brace go through these receiving holes in the bottom cap. The brace sides are then secured to the bottom cap in order to keep the forearm brace in place, and the bottom cap is finally secured to the bottom end of the handle along with the forearm brace.

The brace sides 10 and 12 may be secured to the bottom cap 61 in a variety of ways. In a preferred embodiment, the end 71*a* of the first brace side 10 is threaded and the end 71*b* of the second brace side 12 is threaded. These threaded ends 71*a* and 71*b* go through the receiving holes 63 and 65 in the bottom cap and protrude into the interior of the handle 1. Clamping nuts 73 and 77 are then screwed onto the threaded ends 71*a* and 71*b*, respectively, and clamp the bottom cap 61 between the bend in first brace sides 10 and 12 and clamping nuts 73 and 77.

Figure 21:
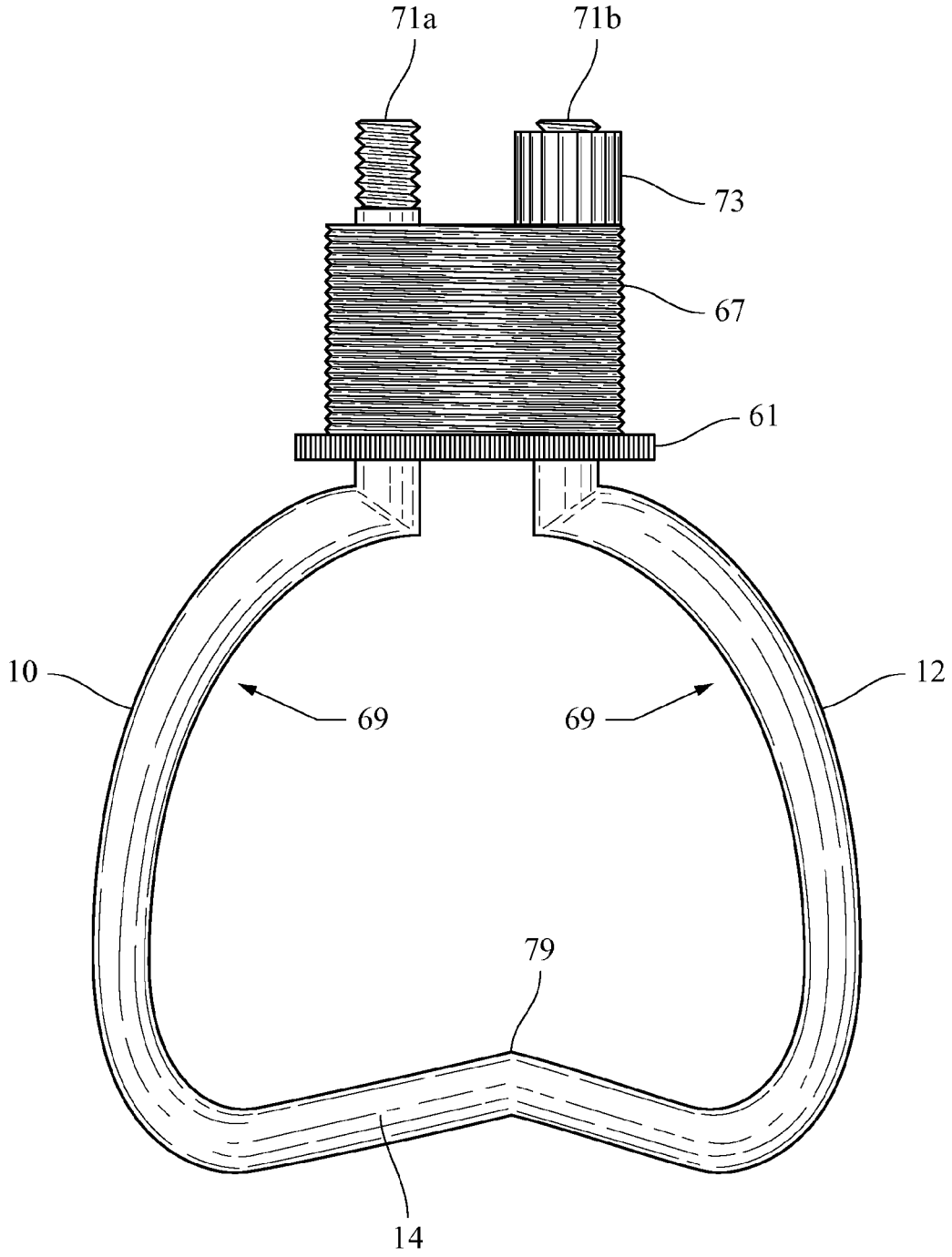
FIG. 21 is a plan view of an exemplary embodiment of the forearm brace connected to the bottom cap in accordance with the present invention.
Figure 22:
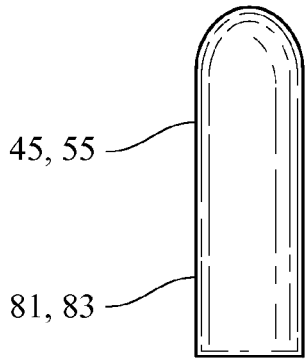
FIG. 22 is an exemplary embodiment of a yoke branch rubber end cap in accordance with the present invention.
Figure 23:
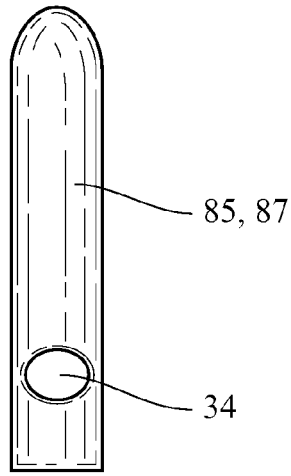
FIG. 23 is an exemplary embodiment of a pouch tube connector in accordance with the present invention.
Figure 24:
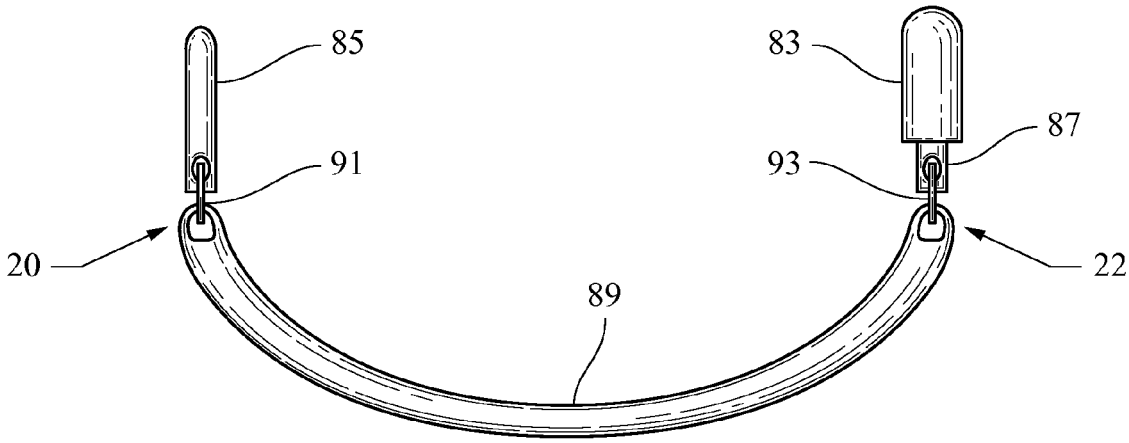
FIG. 24 is a plan view of an exemplary ammo pouch in accordance with the present invention.
Figure 25:
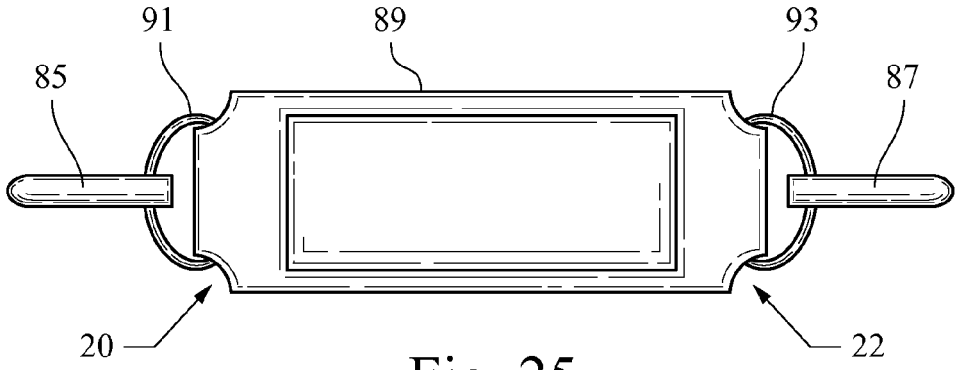
FIG. 25 is a front view of an exemplary ammo pouch in accordance with the present invention.
Figure 26:
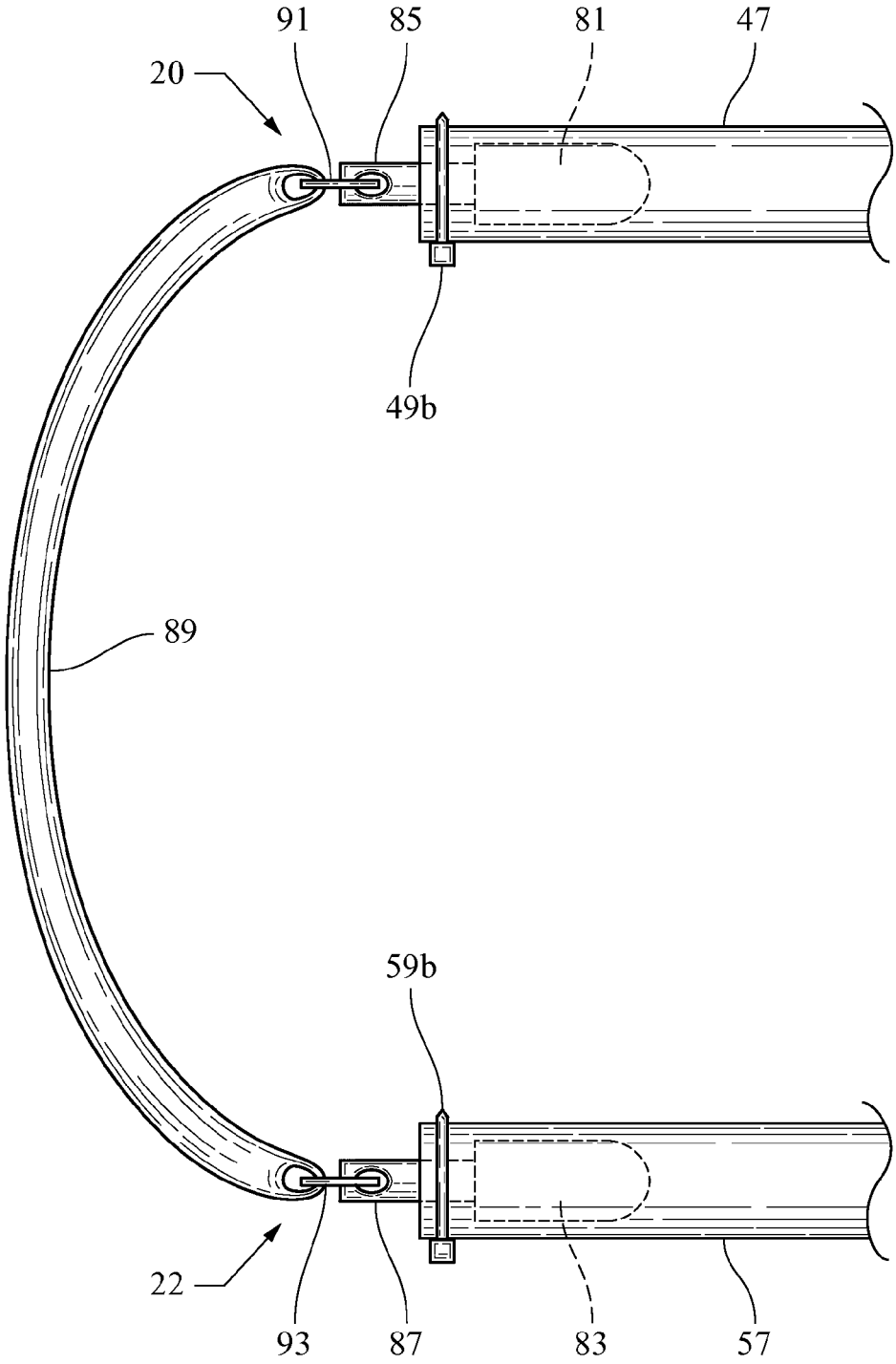
FIG. 26 is a plan view of an exemplary embodiment of the ammo pouch connected to the tubular thrust bands in accordance with the present invention.

As previously discussed, forearm brace 69 is a rod that is shaped at an angle turning upward away from the handle 1, then loops around, and returns back to the handle 1. The top of the loop may comprise a vertical bend 79, as illustrated in FIG. 21. This vertical bend 79 is either bent in the center for an ambidextrous brace, or offset to the right or left for a brace that is specifically configured for right-handed or left-handed shooters. Preferably, the top of the loop extends to a point opposite the handle that is about the same height as the height of the horizontal portion 28 of the first assembly rod side 16 and the second assembly rod side 18 when the handle 1 is held such that its lengthwise axis 4 is at an angle of about 45 degrees with respect to the horizontal axis 24.

Forearm brace 69 may also comprise a comfort pad 95 disposed around the top brace side 14 that is configured to cushion the downward pressure exerted against the top of the forearm by the forearm brace 69. Comfort pad 95 may be formed from a variety of different materials, such as foam or rubber.

Figure 27:
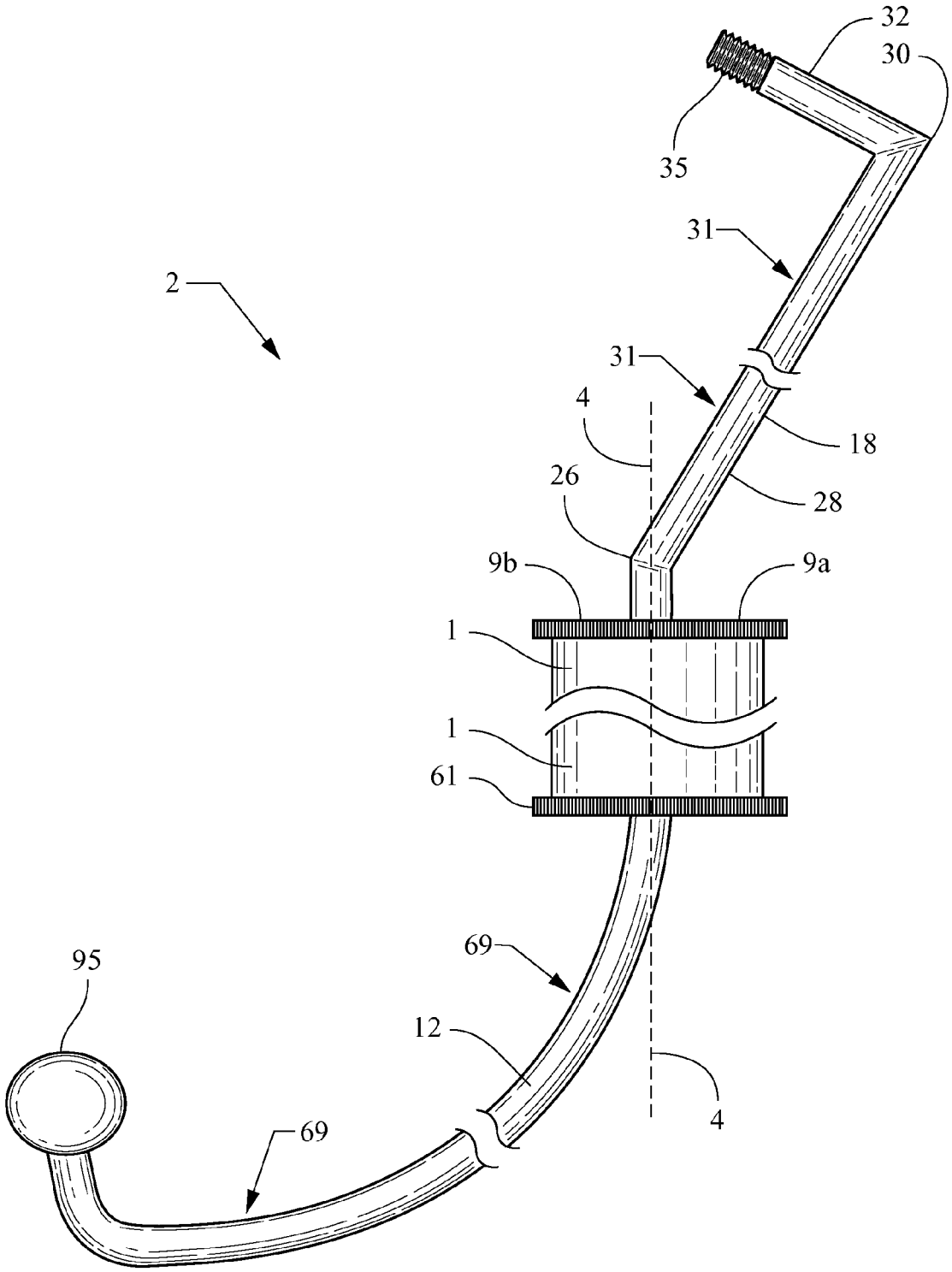
FIG. 27 is a right side view of an exemplary slingshot illustrating the main top assembly rod and forearm brace oriented in a shooting-ready configuration.
Figure 28:
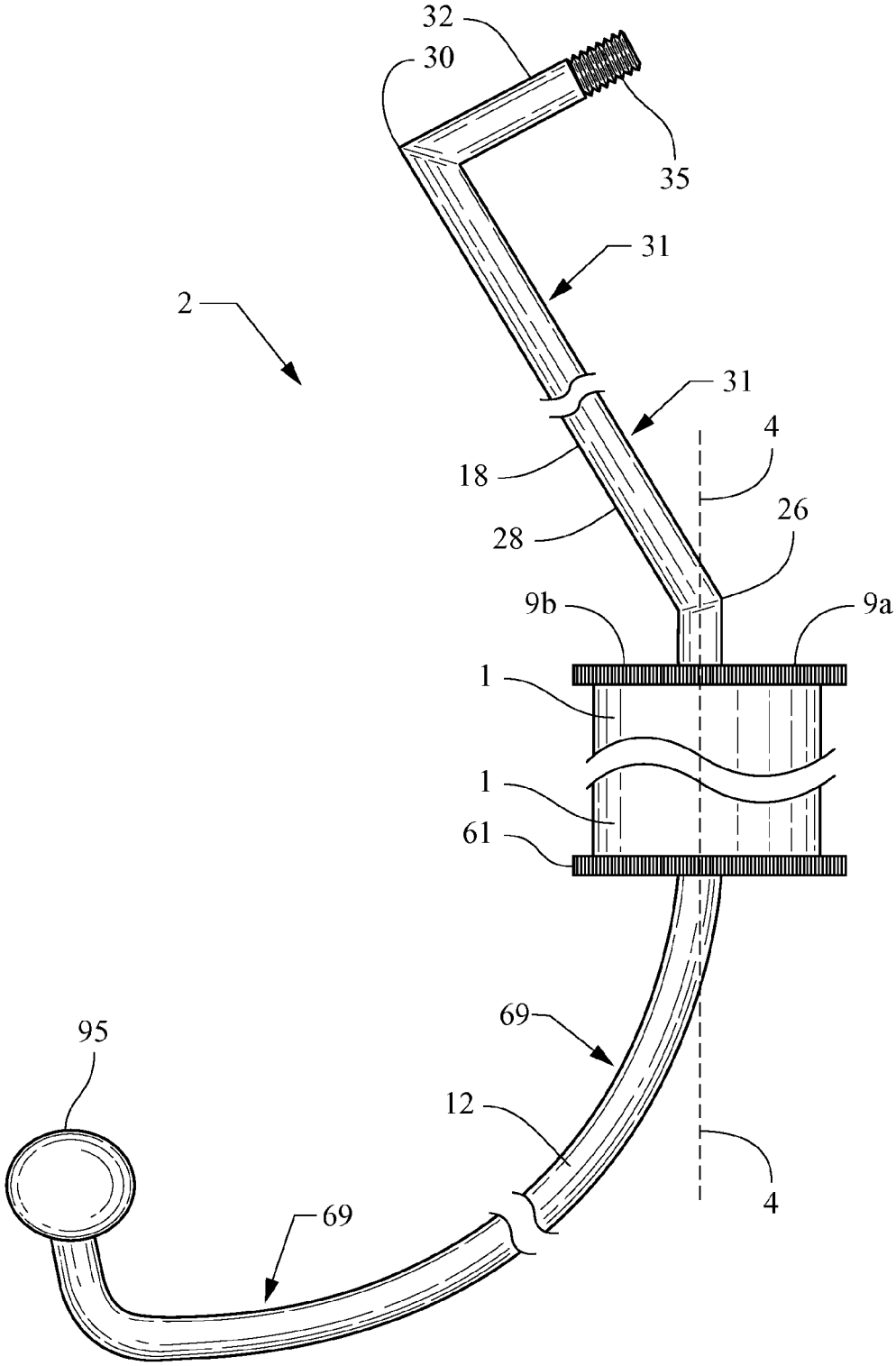
FIG. 28 is a right side view of an exemplary slingshot illustrating the main top assembly rod and forearm brace oriented in a travel-ready configuration.

As discussed above, slingshot 2 may be configured to have assembly rod 31 rotate about 180 degrees from a shooting-ready position, where the user may shoot ammunition from the slingshot, to a travel-ready position, where the user may attach the slingshot to a back pack. FIG. 27 illustrates an exemplary embodiment of the slingshot 2 in a shooting-ready position and FIG. 28 illustrates an exemplary embodiment of the slingshot 2 having assembly rod 31 rotated about 180 degrees from the shooting-ready position to a travel-ready position.

Figure 29:
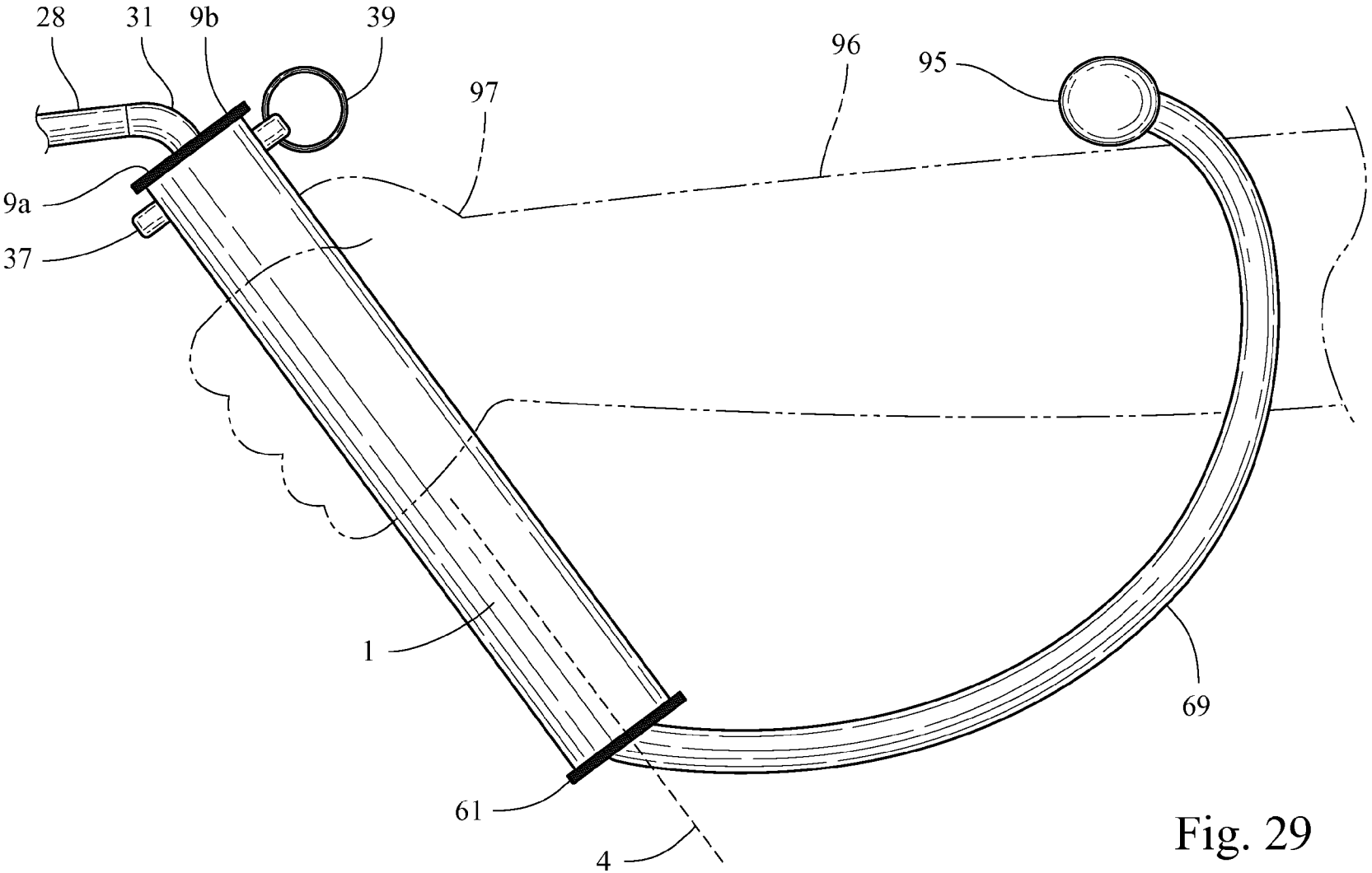
FIG. 29 is a side view of an exemplary embodiment of a user holding the slingshot in accordance with the present invention.

FIG. 29 illustrates an exemplary embodiment of a shooter holding the slingshot 2 in a position intended for shooting. At the shooting grip, the horizontal top area 96 of the forearm and the thumb bone 97, where connected to the upper forearm bone, are aligned horizontally with the horizontal portion of the assembly rod 31. As previously discussed, this alignment provides the shooter with the capability of more velocity and power, while still maintaining stability of the slingshot.

It is contemplated that the main components of the present invention, such as forearm brace 69, handle 1, assembly rod 31, and yoke branches 43 and 53, may be formed from a variety of different materials. In a preferred embodiment, these components are formed from a metal material. For example, these components may be formed from steel or aluminum.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention.

What is claimed is:

1. A high-velocity hunting slingshot comprising:

a handle having a top end, a bottom end opposite said top end, an interior half, an exterior half, and a lengthwise axis separating said interior half from said exterior half;

a forearm brace configured to be coupled to said bottom end of said handle, said forearm brace comprising a first brace side and a second brace side, wherein said first brace side and said second brace side extend away from said bottom end, bending upward in a direction away from said lengthwise axis towards said interior half and then back towards said bottom end, and meeting each other to form a top brace side configured to receive and rest on a user's forearm when said forearm brace is coupled to said bottom end;

an assembly rod configured to be coupled to said top end of said handle, said assembly rod comprising a first assembly rod side and a second assembly rod side, wherein said first assembly rod side and said second assembly rod side extend away from said top end in a V-shape, first bending downward in a direction away from said lengthwise axis towards said exterior half, then bending upwards towards said lengthwise axis when said assembly rod is coupled to said top end;

a left yoke branch configured to be coupled to said first assembly rod side opposite said handle such that said left yoke branch may swivel about said first assembly rod side;

a right yoke branch configured to be coupled to said second assembly rod side opposite said handle such that said right yoke branch may swivel about said second assembly rod side;

an ammunition pouch configured to receive and release ammunition, said ammunition pouch having a first end and a second end opposite said first end;

a first tubular thrust band configured to couple said first end of said ammunition pouch to said left yoke branch opposite said assembly rod; and a second tubular thrust band configured to couple said second end of said ammunition pouch to said right yoke branch opposite said assembly rod.

2. The slingshot of claim 1, wherein said handle is substantially tubular in shape.

3. The slingshot of claim 1, wherein said first tubular trust band and said second tubular thrust band each comprise rubber tubing having an outer diameter of at least ⅜ of an inch.

4. The slingshot of claim 1, wherein said handle and said assembly rod are configured such that said assembly rod may be coupled to said handle in two different securely locked positions, said securely locked positions being a shooting-ready position and a travel-ready position.

5. The slingshot of claim 4, wherein:

said shooting-ready position comprises said first assembly rod side and said second assembly rod side extending away from said top end in a V-shape, first bending downward in a direction away from said lengthwise axis towards said exterior half, then bending upward towards said lengthwise axis and said interior half;

said travel-ready position comprises said first assembly rod side and said second assembly rod side extending away from said top end in a V-shape, first bending upward in a direction away from said lengthwise axis towards said interior half, then bending downward towards said lengthwise axis and said exterior half; and the difference between said shooting-ready position and said travel-ready position is a rotation of said assembly rod of about 180 degrees.

6. The slingshot of claim 4, wherein:

said first assembly rod side and said second assembly rod side each comprise a first bent portion, a horizontal portion, a second bent portion, and a vertical portion, said vertical portion configured to be coupled to said left yoke branch and said right yoke branch; and when said assembly rod is coupled to said top end in said shooting-ready position, said first bent portion extends away from said top end and bends downward in a direction away from said lengthwise axis towards said exterior half, said first bent portion extends into said horizontal portion, said horizontal portion is substantially straight and parallel with the horizontal axis when said handle is held such that its lengthwise axis is at an angle of about 45 degrees with respect to the horizontal axis, said horizontal portion extending into said second bent portion that bends upwards towards said lengthwise axis and leads into said vertical portion, said vertical portion is substantially straight and perpendicular to the horizontal axis when said handle is held such that its lengthwise axis is at an angle of about 45 degrees with respect to the horizontal axis.

7. The slingshot of claim 4, further comprising a top cap having a first half and a second half, said first half and said second half each having an interior surface and an exterior surface, said interior surface having a groove configured to receive said first assembly rod side and a groove configured to receive said second assembly rod side, wherein said interior surface of said first half and said interior surface of said second half are configured to be placed together such that said grooves on said first half and said second half form receiver holes for receiving said first assembly rod side and said second assembly rod side.

8. The slingshot of claim 7, wherein:

said handle comprises a hollow interior at said top end; and said top cap comprises a mating portion configured to mate with said top end of said handle, wherein said top cap is configured to receive said assembly rod and secure said assembly rod to said handle.

9. The slingshot of claim 8, wherein:

said handle is substantially tubular in shape with a threaded interior surface at said top end; and said exterior surface of said first half and said second half of said top cap is threaded and substantially convex, said top cap having a substantially semi-circular exterior surface formed by said exterior surface of said first half and said second half and configured to mate with said threaded interior surface of said top end.

10. The slingshot of claim 8, further comprising a linchpin, wherein said handle comprises an aperture on two opposite sides proximate said top end; said first half and said second half of said top cap each comprise an aperture that corresponds in location and size to said apertures on said handle and extends from said interior surface to said exterior surface; and said apertures on said handle and said top cap are configured to line up when said top cap is coupled to said handle and receive said linchpin such that said linchpin prevents the rotation of said top cap and said assembly rod with respect to said handle.

11. The slingshot of claim 4, further comprising a forearm brace comfort pad coupled to said top brace side.

12. The slingshot of claim 4, wherein said top brace side comprises a substantially off-center bend.

13. The slingshot of claim 4, wherein said ammunition pouch is a nylon strap.

14. The slingshot of claim 4, wherein said ammunition pouch comprises a first ring attached to said first end and second ring attached to said second end.

15. The slingshot of claim 14, further comprising:

a first pouch tube connector configured to secure said first tubular thrust band to said first end of said ammunition pouch and a second pouch tube connector configured to secure said second tubular thrust band to said second end of said ammunition pouch, wherein said first and second pouch tube connector each have a hole proximate one end and an end cap positioned at the opposite end from said one end, said hole on said first and second pouch tube connector is configured to receive and secure said first and second ring respectively, said end cap being greater in diameter than the rest of said first and second pouch tube connector; and a first securing mechanism configured to secure said first pouch tube connector to said first tubular thrust band and a second securing mechanism configured to secure said second pouch tube connector to said second tubular thrust band.

16. The slingshot of claim 15, wherein said first securing mechanism and said second securing mechanism are zip-ties configured to lock said first and second tubular thrust band to said first and second pouch tube connector respectively between said end cap and said hole.

17. The slingshot of claim 15, wherein said end cap is formed from a rubber material.

18. The slingshot of claim 6, wherein:

said left yoke branch comprises a left vertical branch, having a first end and a second end opposite said first end, and a left horizontal branch, having a first end and a second end opposite said first end, said first end of said left vertical branch configured to be coupled to said vertical portion of said first assembly rod side, said second end of said left vertical branch extending into said first end of said left horizontal branch, said second end of said left horizontal branch configured to be coupled to said first tubular thrust band, said left vertical branch and said left horizontal branch disposed substantially perpendicular with respect to one another;

said right yoke branch comprises a right vertical branch, having a first end and a second end opposite said first end, and a right horizontal branch, having a first end and a second end opposite said first end, said first end of said right vertical branch configured to be coupled to said vertical portion of said second assembly rod side, said second end of said right vertical branch extending into said first end of said right horizontal branch, said second end of said right horizontal branch configured to be coupled to said second tubular thrust band, said right vertical branch and said right horizontal branch disposed substantially perpendicular with respect to one another, wherein said left and right horizontal branches are substantially parallel with the horizontal axis when said handle is held such that its lengthwise axis is at an angle of about 45 degrees with respect to the horizontal axis.

19. The slingshot of claim 18, wherein said second end of said left horizontal branch and said second end of said right horizontal branch each comprise a branch end cap, said branch end cap being greater in diameter than the rest of said left and right horizontal branch; and a first branch-tube securing mechanism configured to secure said first left horizontal branch to said first tubular thrust band and a second branch-tube securing mechanism configured to secure said right horizontal branch to said second tubular thrust band.

20. The slingshot of claim 19, wherein said first branch-tube securing mechanism and said second branch-tube securing mechanism are zip-ties configured to lock said first and second tubular thrust band to said left horizontal branch and said right horizontal branch respectively between said branch end cap and said left and right vertical branch.

* * * * *